United States Patent [19]

Hawley et al.

[11] Patent Number: 4,638,842

[45] Date of Patent: Jan. 27, 1987

[54] CLOSED CIRCUIT REFUELING NOZZLE

[75] Inventors: Frank D. Hawley, Chelsea; Russell L. Rogers, Munith, both of Mich.

[73] Assignee: Aeroquip Corporation, Jackson, Mich.

[21] Appl. No.: 752,837

[22] Filed: Jul. 8, 1985

[51] Int. Cl.[4] ..... B65B 3/04

[52] U.S. Cl. ..... 141/302; 141/348

[58] Field of Search ..... 141/346–362, 141/285–310

[56] References Cited

U.S. PATENT DOCUMENTS

| | | | |
|---|---|---|---|
| 2,556,221 | 6/1951 | Samiran | 141/348 |
| 2,716,999 | 9/1955 | Badger, Jr. et al. | 141/348 |
| 2,948,307 | 8/1960 | Rittenhouse et al. | 141/348 |

OTHER PUBLICATIONS

Department of the Army Technical Manual TM 5-2930-226-12&P, "Nozzle Assembly, Closed Circuit Refueling with Strainer Assembly", Oct., 1977.

*Primary Examiner*—Houston S. Bell, Jr.
*Attorney, Agent, or Firm*—Beaman & Beaman

[57] ABSTRACT

A fueling nozzle for closed circuit fuel systems comprising a body having a passage including inlet and outlet ends. A reciprocal plunger within the passage serves to open the fuel tank inlet and cooperates with a valve to close the nozzle when not in use. A reciprocal differential pressure actuated pressure regulating sleeve within the passage is positioned relative to a valve seat in accord with the nozzle fluid pressure and the nozzle passage is exposed only to regulated pressure. An indicator mounted on the body senses the position of the pressure regulator sleeve to give a visual indication of the position and condition of the regulator sleeve.

11 Claims, 5 Drawing Figures

CLOSED CIRCUIT REFUELING NOZZLE

BACKGROUND OF THE INVENTION

In a closed circuit fuel system such as employed with aircraft, a fueling nozzle is firmly attached to a fuel tank inlet in a fluid-tight and mechanical manner wherein a sealed relationship exists between the nozzle and the tank inlet. Such systems are used with "under-wing" fuel inlets, and the fuel is forced into the fuel tank under pressure.

With fuel systems of the closed circuit type, it is critical that the nozzle be firmly attached to the tank inlet in a sealed manner, the nozzle must include effective seals to prevent leakage, the operation of the nozzle components must be positive and safely operable, fluid flow through the nozzle must not occur until proper attachment with the tank inlet has been made, fuel flow through the nozzle must be relatively unrestricted and the pressure should be regulated protecting fuel system components from high pressure fuel, and the nozzle should automatically close upon the fuel tank being filled.

While fueling nozzles for closed circuit sytems are available which meet some of the aforementioned prerequisites, there is a need for a closed circuit nozzle which overcomes the disadvantages of nozzles presently available. For instance, available closed circuit fueling nozzles are prone to sealing and leaking problems. Many of these problems may be attributable to the fact that the interior of the nozzle is subjected to the maximum fuel pressure of the fuel supply system when the nozzle is not in use. Also, pressure regulation and automatic shut off are not as dependable as desired and the condition of the pressure regulating components are not discernible by the operator.

Fueling nozzles of the closed circuit type often incorporate springs located within the fluid flow passage and there is the possibility that spring fractures would permit particles to enter the fuel system. Other deficiencies present in available closed circuit nozzles exist in the operation of the various nozzle components wherein undesirable rotation of the manually operated locking sleeve creates problems.

It is an object of the invention to provide a closed circuit fueling nozzle having improved sealing characteristics at dynamic surfaces, and wherein long effective seal life is achieved.

Another object of the invention is to provide a closed circuit fueling nozzle which automatically prevents fluid flow therethrough until the nozzle is properly mounted upon the tank inlet, and improper connection of the nozzle to the inlet, or unintentional nozzle disconnection, automatically closes the nozzle.

A further object of the invention is to provide a closed circuit nozzle incorporating a pressure regulator wherein the regulator controls the pressure of the fuel within the nozzle passage, and the primary portion of the nozzle passage is only subjected to regulated pressure.

An additional object of the invention is to provide a closed circuit fueling nozzle having a positive latching mechanism for attaching the nozzle to the tank inlet, and wherein the latching mechanism is sensitive to the alignment and connection to the tank inlet and will not permit coupling until proper alignment and interconnection has been achieved.

Yet another object of the invention is to provide a closed circuit fueling nozzle employing a pressure regulating spring-biased sleeve wherein the spring is isolated from the fuel flow path, and indicating means are defined on the nozzle sensing the position of the regulator sleeve and visually indicating to the operator the position and condition of the sleeve.

In the practice of the invention the nozzle includes a body in which an elongated passage is defined. The passage includes an inlet end, and an outlet end in axially spaced relationship to the inlet end. A fuel supply hose is attached to a supply channel defined in the body which selectively communicates with the passage.

An elongated plunger concentrically located within the body passage is axially positionable therein between extended and retracted positions by a manually operated handle through a rack and pinion drive. The plunger includes an enlarged head disposed adjacent the passage outlet end, and a chamber formed in the body concentric to the plunger receives a piston mechanically connected to the plunger. The chamber communicates with the passage and fluid pressure acting on the piston balances that pressure tending to force the plunger head in the opposite direction.

An annular valve sleeve located within the body passage inwardly of the plunger head is spring biased toward the head for sealed engagement therewith. The valve sleeve is also accessible from the passage open end and is held in an open position by the fuel tank inlet structure. The plunger is used to open a self-closing valve in the tank inlet and the valve sleeve will automatically engage the plunger head to seal the body passage outlet end when the nozzle is removed from the tank inlet.

An elongated annular axially displaceable pressure regulating sleeve is located within the nozzle body passage intermediate the inlet and outlet ends. The regulator sleeve includes differential area pressure faces exposed to the fuel pressure, and is biased by a spring in a direction away from an annular valve seat defined in the passage adjacent the inlet end and fuel supply. The open annular end of the regulator sleeve functions as a valve directly engagable with the valve seat, and as the regulator sleeve is sealed with respect to the body passage, engagement of the regulator sleeve with the valve seat seals the body passage with respect to the fuel supply channel preventing most of the interior of the nozzle from being exposed to the maximum fuel pressure existing within the supply channel.

The spring for the pressure regulator sleeve circumscribes the sleeve and is isolated from the fuel flow therethrough. As the regulator sleeve is always exposed to the fluid pressure within the body passage the sleeve will position itself to the valve seat to achieve the desired predetermined pressure as controlled by the relative areas of the differential pressure faces and the characteristics of the spring.

An axially displaceable rod is mounted within the body which engages the pressure regulator sleeve as the sleeve approaches its valve seat, and the rod includes a lost motion connection with an outer end which is visually observable whereby the operator is immediately advised of the position and condition of the regulator sleeve.

A manually operated locking sleeve reciprocally mounted on the exterior of the body adjacent the passage outlet end cooperates with pivotal latch fingers which grip the tank inlet to maintain the interconnection between the tank inlet and nozzle. Release pins mounted on the body adjacent the passage outlet end engage the tank inlet to automatically release detents which restrain the locking sleeve against movement in the locking direction until proper alignment and positioning of the nozzle and tank inlet has been achieved.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
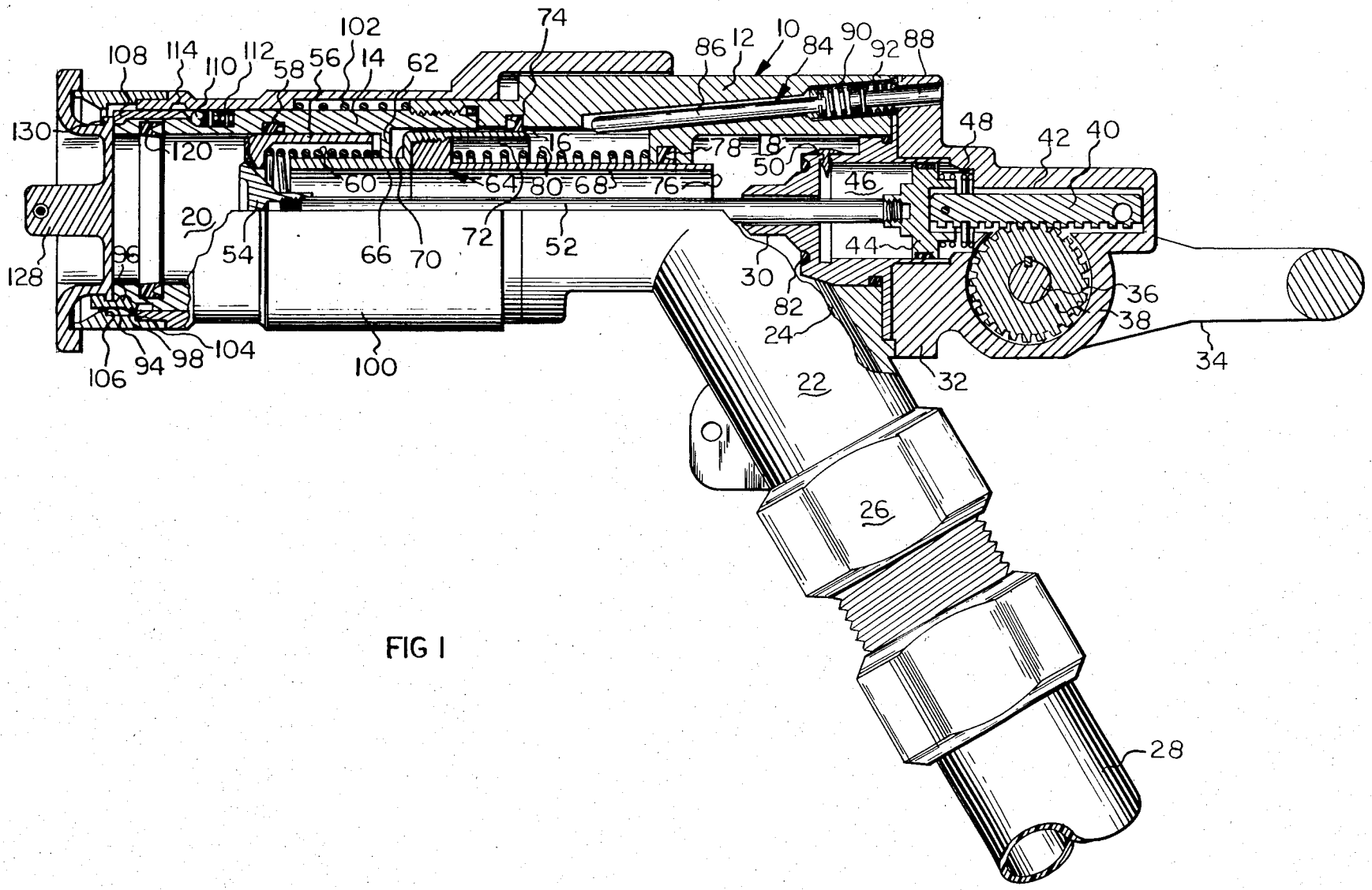
FIG. 1 is an elevational view, partially in section, illustrating a fuel nozzle in accord with the invention wherein the nozzle open end is closed by a dust cover, the plunger is in the retracted position and no pressurized fuel is being supplied to the nozzle.

A closed circuit fuel nozzle in accord with the invention includes a body 10 consisting of the cast primary portion 12 and the tubular adapter portion 14 threaded into portion 12 and sealed with respect thereto. The body 10 includes an elongated internal and generally cylindrical passage 16 having an inlet end 18, and an outlet end generally designated at 20. The body portion 12 includes the offset section 22 in which the fuel supply channel 24 is formed. The section 22 is provided with a fitting 26 wherein the fuel supply hose 28 may be attached thereto in a known manner. It is to be noted that the fuel supply channel 24 communicates with the passage 16 at the inlet end 18.

The right end of the nozzle passage, as viewed in FIG. 1, is enclosed by the guide 30 and the end cap 32 attached to the body portion 12 by screws, not shown. The end cap 32 supports a U-shaped handle 34 for pivotal movement about the shaft 36, and the shaft is keyed to gear 38. A gear rack 40 reciprocal within the bore 42 of the end cap meshes with the teeth of gear 38 wherein rotation of the handle 34 from the "closed" or "retracted" position shown in FIG. 1 to the "open" or "extended" position of FIG. 3 will axially displace the rack to the left. The rack 40 is connected to a piston 44 reciprocally mounted within chamber 46 defined in the guide 30, and a spring 48 biases the piston toward the left, FIG. 1. A check valve 50 communicates with the chamber 46 and the passage inlet end 18 for a purpose later described.

An elongated plunger 52 extends concentrically through the guide 30 and is threaded into the piston 44 at its inner end. The outer end of the plunger 52 includes a conical head 54 mounted thereon and as the plunger is attached to the piston 44, the plunger will be axially reciprocated within the body passage as the handle 34 is operated to extend or retract the plunger. As will be appreciated from the drawings, the plunger head 54 is located within the open outlet end 20 of the passage 16.

An annular valve sleeve 56 is reciprocally mounted within the passage 16 adjacent the outlet end and is sealed with respect to the passage by a seal ring 58. An elastomeric material is bonded to the outer face of the valve seat and a compression spring 60 interposed between the valve seat and the body shoulder 62 biases the sleeve toward the left for engagement with the inner conical surface of the plunger head 54 as shown in FIG. 1. Accordingly, it will be appreciated that engagement of the valve sleeve 56 with the head 54 will seal the passage preventing fluid flow from the outlet end 20.

A pressure regulator sleeve 64 is also reciprocally mounted within the body passage 16, and the regulator sleeve is formed of a tubular portion 66 threadedly interconnected with the tubular portion 68. The tubular portion 66 includes a radially extending pressure face 70, and the skirt 72 thereof is sealed with respect to the body by elastomeric seal 74. The regulator sleeve portion 68 includes an annular end 76 which constitutes a valve and also a radial pressure face of lesser area than the face 70. The portion 68 is sealed to the body 10 by annular elastomeric seal 78 and compression spring 80 is interposed between the body and regulator sleeve biasing the sleeve toward the left, FIG. 1. It will be noted that the seals 74 and 78 and the sleeve portion 68 isolate the spring 80 from the interior flow path of the regulator sleeve 64 and any broken spring particles will not enter the flow path.

An annular elastomeric seat 82 is defined upon the guide 30 in axial alignment with the regulator sleeve end 76 and will be engaged by the sleeve end 76 when the regulator sleeve is in its rightmost position, which is the "closed" condition. In such instance the sleeve 64 will seal the body passage 16 from the fuel supply channel 24, except for the inlet end 18 of the body passage, and the passage will not be exposed to the fluid pressure within the supply channel.

Figure 2:
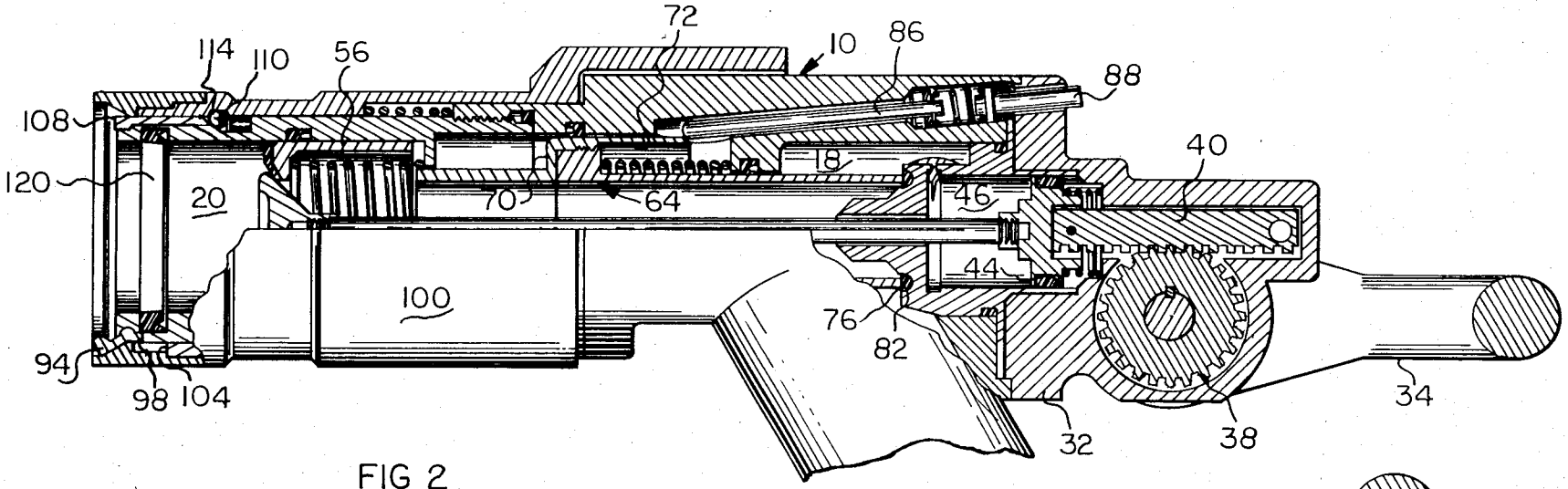
FIG. 2 is an elevational, sectional view of the nozzle, the dust cover being removed prior to coupling to the tank inlet, the plunger is in the retracted position, pressurized fuel is supplied to the nozzle supply channel and the pressure regulator sleeve is engaging its valve seat.
Figure 4:
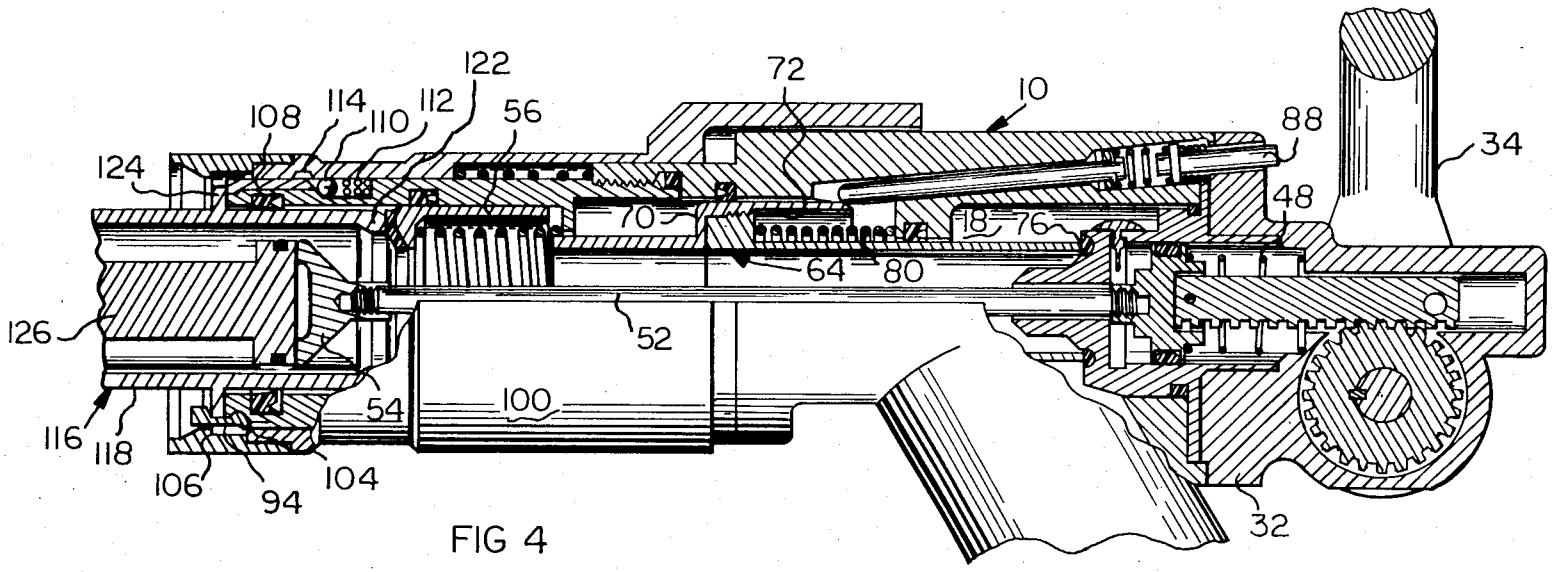
FIG. 4 is an elevational view of a nozzle, partially in section, illustrating the relationship of the components upon the tank being filled, the pressure within the nozzle causing the regulator sleeve to close, the plunger being in the extended position.
Figure 5:
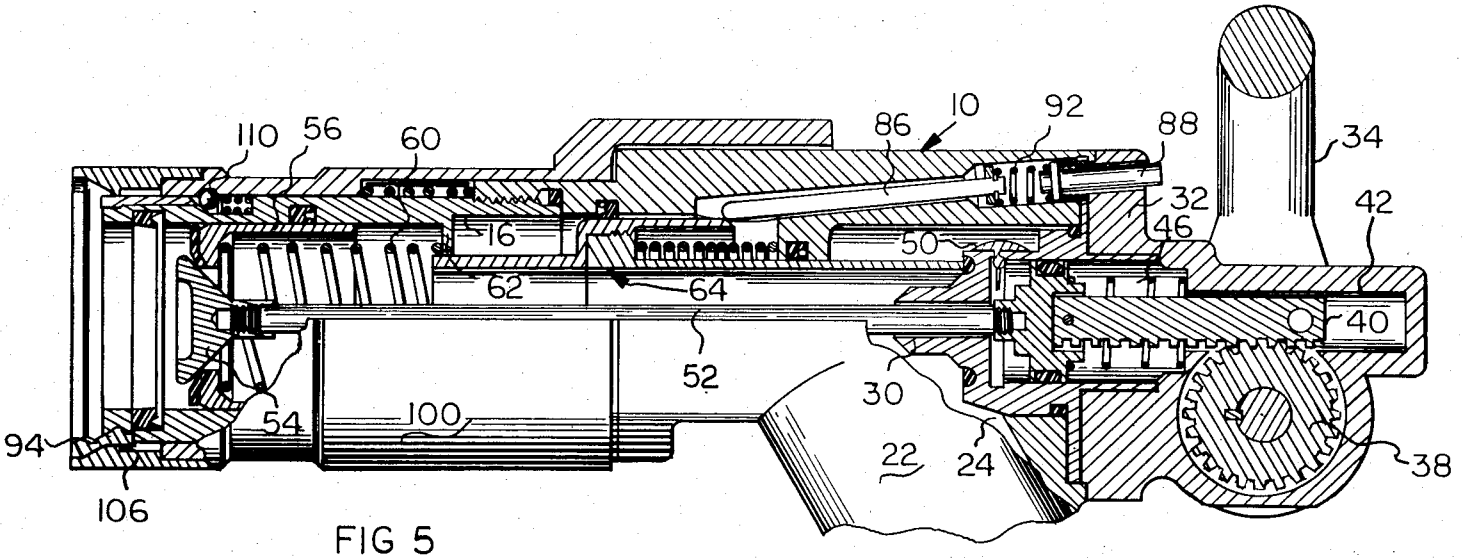
FIG. 5 is an elevational view, partially in section, of the nozzle in accord with the invention, illustrating the relationship of the components in the event of unintentional disconnection of the nozzle from the tank inlet, the valve sleeve sealingly engaging the plunger head, and the pressure regulator sleeve engaging its valve seat.

An indicating rod 84 is reciprocally mounted within the body 10 and end cap 32 for engagement with the pressure regulator sleeve 64 to give a visual indication of the position of the regulator sleeve as it approaches and engages the valve seat 82. The rod 84 consists of two aligned portions 86 and 88 interconnected by a lost motion connection consisting of spring 90. A smaller spring 92 biases the portion 88 to the left, wherein the rod portion 88 will not extend from the end cap under normal conditions. However, when the regulator sleeve 64 approaches and engages the valve seat 82 the inner end of the rod portion 86 engages the skirt 72 which moves the rod 86 to the right compressing spring 90 and overcoming spring 92 forcing the rod portion 88 to the right for extension from the end cap as shown in FIGS. 2, 4 and 5 whereby the portion 88 will be visible to the operator to indicate that the pressure regulator sleeve is in a closed condition.

Attachment of the nozzle to the fuel tank inlet is achieved by six hooked latch fingers 94 pivotally mounted upon the leftmost end of the body 10. The latch fingers are formed with a bulbous pivot portion 96 and a lever abutment 98 engagable with the locking sleeve.

Figure 3:
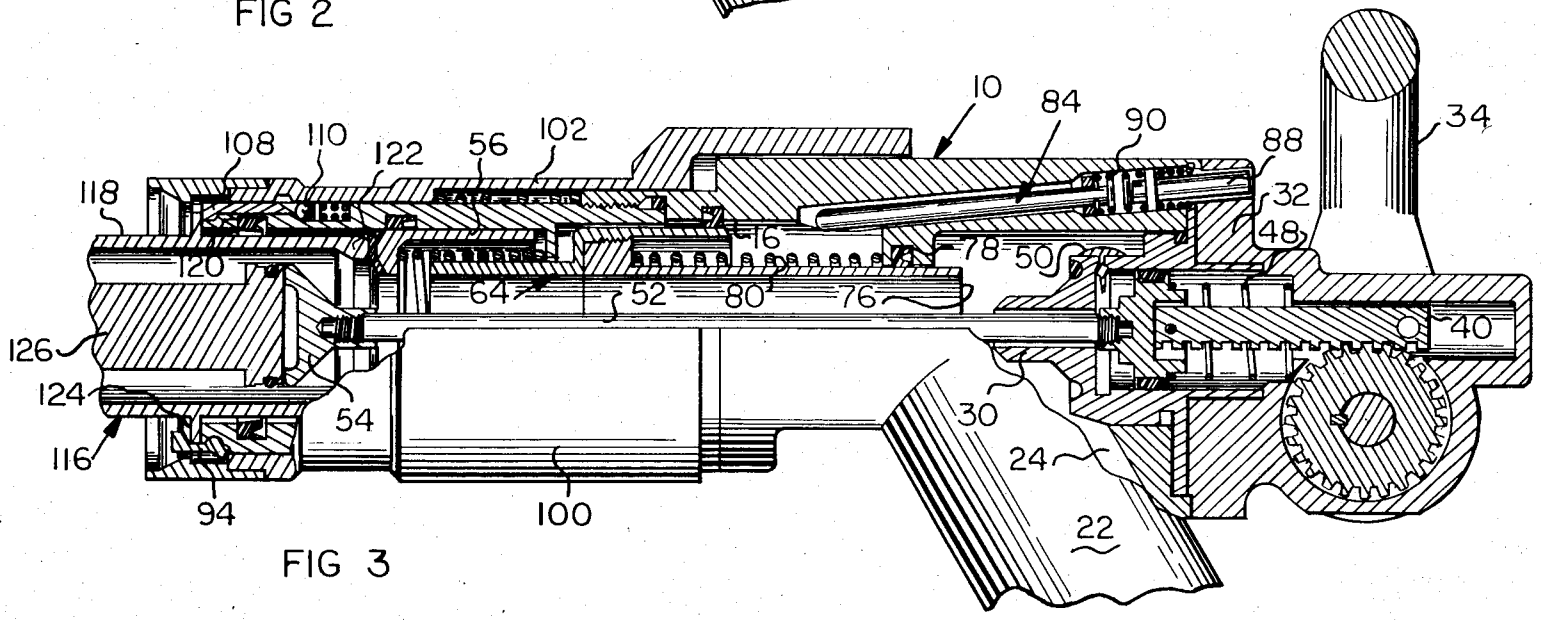
FIG. 3 is an elevational, sectional view of a nozzle in accord with the invention wherein the nozzle is coupled to the aircraft tank inlet, the plunger and pressure regulator sleeve are in the open fuel flow position and the locking sleeve and latch fingers are in the locked position.

The locking sleeve 100 is reciprocally mounted on the exterior of the body 10 and is keyed to prevent relative rotation to the body. The sleeve 100 is biased toward the left, FIG. 1, by spring 102, and at its outer end the sleeve includes a radial abutment shoulder 104 and a tip having a radial shoulder 106. As will be appreciated from the drawings, the finger lever 98 is located between the shoulders 104 and 106 and is in axial alignment therewith. Thus, when the locking sleeve 100 is at its locking or leftmost position, the shoulder 104 will be engaging the finger abutment lever 98 and rotate the latch fingers 94 inwardly to grip the dust cap as shown in FIG. 1, or to grip the fuel tank inlet as shown in FIGS. 3 and 4. When the locking sleeve 100 is shifted to its release or rightmost position, the shoulder 106 engages the finger abutment lever 98 and pivots the fingers 94 outwardly as shown in FIGS. 2 and 5.

In order to prevent the locking sleeve 100 from shifting to its lock position prior to the nozzle being properly located upon the tank inlet, a pair of release pins 108 are reciprocally mounted upon the nozzle body at the passage outlet end. Two ball detents 110 located within a recess formed in the body and biased to the left by springs 112 may be displaced by the pins 108 in an axial direction to permit release from the locking sleeve recesses 114. When the locking sleeve 100 is in its release position of FIGS. 2 and 5, the springs 112 will force the ball detents 110 into the recess 114 which holds the locking sleeve in its release position. Upon the release pins 108 being moved to the right, the ball detents will be forced from the recesses 114 and thereby permit the locking sleeve 100 to move to the left and pivot the latch fingers 94 to a closed or locked position.

While the fuel tank inlet 116 may take several forms, a configuration is shown in FIGS. 3 and 4 which includes the necessary components and structural relationships to permit cooperation with the nozzle of the invention. For instance, the fuel tank inlet includes a tubular cylindrical nose 118 which is received within the passage open end and seals with respect to the passage by means of the annular elastomeric seal 120 positioned within a groove in the body passage at the outlet end 20. The nose 118 includes abutment end 122 defining an opening through which the plunger head 54 may pass, but the abutment engages the valve sleeve 56 for preventing axial movement of the valve sleeve against the influence of the spring 60. The tank inlet also includes an annular rib ridge 124 for cooperating with the nozzle latch fingers 94, and internally, the tank inlet will include a self-sealing valve 126 which seats against end 122 and which is engagable by the plunger head 54.

In FIG. 1, the relationship of the components is that which exists prior to pressurization of the nozzle with fuel from hose 28. The handle 34 will be in the off position which retracts plunger 52 and head 54 will be engaged by the valve sleeve 56. The pressure regulator sleeve 64 will be biased toward the left under the influence of spring 80, away from valve seat 82, and the locking sleeve 100 will be biased toward the left by spring 102 pivoting the latch fingers 94 inwardly to grip the dust cap 128 by its ridge 130.

In operation, the fuel supply hose 28 will be provided with a pressurized fuel which will enter the body passage 16 and pressurize the same. Immediately, the fluid forces acting upon the regulator sleeve face 70 will displace the sleeve 64 to the right against the valve seat 82 closing the body passage 16 from communication with the supply channel 24 except for the inlet end 18. This movement of the regulator sleeve to the right engages the inner end of the indicator rod 84 with the skirt 72 shifting the rod to the right wherein the rod portion 88 will be visible at the end cap 32, as appreciated from FIG. 2 wherein the pressurize nozzle condition is illustrated prior to connection to the aircraft tank inlet.

Before attaching the nozzle to the fuel tank inlet 116, the locking sleeve 100 will be manually moved to the right to align the recesses 114 with the ball detents 110 to hold the locking sleeve in its release position. This movement of the locking sleeve will engage shoulder 106 with the lever 98 to pivot the latch fingers 94 to the release position shown in FIG. 2, and after the dust cap 128 is removed the nozzle may be aligned with the tank inlet 116 and pushed thereon with an axial movement.

As the nozzle is placed upon the tank inlet 116, the inlet nose 118 enters the outlet end 20 and seal 120 establishes a fluid-tight relationship between the nozzle and tank inlet. Further relative axial movement engages the inlet abutment end 122 with the valve sleeve 56, and simultaneously, the release pins 108 will be axially moved inwardly due to engagement with the inlet ridge 124 forcing the ball detents 110 radially inwardly and out of their associated recess 114. Release of the detents permits the locking sleeve 100 to move to the left engaging abutment shoulder 104 with the latch finger lever 98 pivoting the latch fingers 94 to a closed condition gripping ridge 124. The nozzle is now firmly mechanically connected to the tank inlet 116.

The operator now moves the handle 34 in a counterclockwise direction through 90° which, through gear 38 and rack 40, shifts the plunger 52 toward the left. This manual operation of the handle may be readily achieved because of the balancing effect of the fluid forces imposed on the plunger head 54 and the face of the piston 44. During this shifting, fluid escapes from the chamber 46 through the check valve 50.

As the plunger 52 is moved to the left, the head 54 engages the tank inlet valve member 126 to open the tank valve, as shown, and as the abutment end 122 will hold the valve sleeve 56 against axial displacement fluid may now flow from the body passage outlet end 20. This release of pressure in passage 16 permits the pressure regulator sleeve 64 to shift to the left under the influence of spring 80, and the sleeve will be maintained in the open position shown in FIG. 3 as the fuel flows through the nozzle due to the low pressure of the flowing fuel. As will be appreciated, the displacement of the regulator sleeve 64 to the left permits the indicator rod 84 to shift toward the left removing the portion 88 from observation.

It will be noted in FIG. 3 that during fluid flow the pressure regulator sleeve portion 66 will be located within the valve sleeve spring 60 substantially isolating the spring 60 from the fluid flow. Thus, any spring breakage that might occur during fluid flow will be prevented from entering the fuel system, as is the case with spring 80.

When the tank has been filled, the pressure within the nozzle passage 16 will increase, and the pressure regulator valve sleeve 64 will shift to its closed position against seat 82 as shown in FIG. 4. This movement of the regulator sleeve will seal the primary portion of passage 16 against communication with the high pressure fuel within channel 24 and fluid flow through the nozzle terminates. Indicator rod portion 88 will now be visible.

The operator then pivots the handle 34 clockwise 90° to the position of FIG. 2 which will retract the plunger head 54 against the valve sleeve 56 closing the nozzle passage outlet end, and simultaneously permitting the tank inlet valve to close. The operator then manually displaces the locking sleeve 100 toward the right engaging abutment shoulder 106 with the latch finger lever abutment 98 pivoting the latch fingers 94 to the release position and permitting the nozzle to be removed from the tank inlet 116. The components will now be related as shown in FIG. 2, and if desired, the dust cap 128 may be replaced and held in position by shifting the locking sleeve 100 to the left. It will be appreciated that installation of the dust cap actuates the release pins 108 to permit movement of the locking sleeve.

In the event of an unintentional disconnection of the nozzle from the tank inlet 116, i.e. the operator shifts the locking sleeve 100 to the right prior to pivoting handle 34 and shifting plunger 52 and plunger head 54 to the retracted position, significant fuel loss is prevented by the valve sleeve 56 which would immediately shift to the position shown in FIG. 5 against plunger head 54 and seal the outlet end 20 of the body passage. Simultaneously, the existence of a high pressure within the body would cause the pressure regulator sleeve 64 to move to the right and seal against valve seat 82 closing the body passage with respect to the fuel supply channel 24. The operator may then move the handle 34 to the off or retracted position of FIGS. 1 and 2, and this movement is possible as fuel within the passage 10 may pass through check valve 50 into the inlet end 18 and supply channel 24.

The arrangement of the seals, the incorporation of the pressure regulator sleeve within the body to limit the exposure of high pressure, the isolation of the springs 66 and 80 relative to the fuel flow, and the use of the indicator rod 84, in conjunction with other advantageous features of the invention, together, contribute to the advance made in the art by the instant invention, and it is appreciated that various modifications to the inventive concepts may be apparent to those skilled in the art without departing from the spirit and scope of the invention.

We claim:

1. A fueling nozzle for a closed circuit fuel system having a fuel tank inlet comprising, in combination, a hollow tubular body having an elongated passage having an inlet end and an outlet end, a fuel supply channel defined in said body in communication with said passage inlet end, releasable fuel tank inlet connection means defined on said body adjacent said passage outlet end movable between lock and release positions, operating means associated with said connection means mounted on said body movable between lock and release positions, an elongated plunger concentrically mounted within said elongated passage for axial movement between extended and retracted positions, said plunger having an inner end located adjacent said passage inlet end and an outer end adjacent said passage outlet end, an enlarged head mounted on said plunger outer end, plunger operating means mounted on said body connected to said plunger for translating said plunger between said extended and retracted positions, an annular valve sleeve sealingly received within said body passage adjacent to and accessible from said outlet end and axially displaceable between plunger head engaged and disengaged positions, engagement of said valve sleeve and plunger head closing said passage outlet end to fluid flow therethrough and connection of said body to a fuel tank inlet when said plunger is in said extended position disengaging said valve sleeve from said head to open said passage outlet end, first spring means axially biasing said valve sleeve toward said plunger head, an annular pressure regulator sleeve concentrically located within said body passage between said plunger head and passage inlet end axially displaceable within said passage and sealed with respect thereto, a valve seat defined within said body passage adjacent said passage inlet end in alignment with said regulator sleeve, valve means defined on said regulator sleeve engagable with said valve seat to close the interior of said regulator sleeve with respect to said fuel supply channel, differential pressure faces defined on said regulator sleeve exposed to the fluid pressure within said body passage imposing opposite axial forces on said regulator sleeve, and second spring means within said body imposing an axial force on said regulator sleeve tending to separate said regulator sleeve valve means and said valve seat, a predetermined pressure within said body passage axially displacing said regulator sleeve against the force of said second spring to engage said valve means and valve seat and close the interior of said regulator sleeve with respect to said fuel supply channel.

2. In a fueling nozzle for a closed circuit fuel system as in claim 1, said pressure regulator sleeve including an annular end, said valve seat comprising an annular elastic seal concentrically located within said body passage in axial alignment with said regulator sleeve annular end, said regulator sleeve annular end comprising said regulator sleeve valve means.

3. In a fueling nozzle for a closed circuit fuel system as in claim 1, said releasable fuel tank connection means comprising a plurality of latch fingers pivotally mounted upon said body pivotal between said lock and release positions, said operating means associated with said connection means comprising an annular locking sleeve reciprocally mounted on the exterior of said body manually translatable between lock and release positions, latch finger engaging means defined on said locking sleeve engaging and pivoting said latch fingers to said lock position at said locking sleeve lock position and pivoting said fingers to said release position at said locking sleeve release position.

4. In a fueling nozzle for a closed circuit fuel system as in claim 3, a spring mounted on said body biasing said locking sleeve toward said sleeve's lock position, release means mounted on said body adjacent said body passage outlet end releasably retaining said locking sleeve in its release position, said release being engagable by the fuel tank inlet and releasing said locking sleeve for movement to its lock position upon proper alignment and engagement of said body passage outlet end with the fuel tank inlet.

5. In a fueling nozzle for a closed circuit fuel system as in claim 4, said release means including axially displaceable pins mounted on said body, radially displaceable detents interposed between said body and locking sleeve radially movable between locking sleeve retaining and release positions, said pins engaging said detents and displacing said detents from said retaining to said release positions upon proper alignment and engagement of said body passage outlet end with the fuel tank inlet.

6. In a fueling nozzle for a closed circuit fuel system as in claim 1, a differential pressure face operatively associated with said plunger in communication with said body passage whereby fluid pressure acting upon said face imposes an axial force on said plunger opposite to that axial force imposed upon said plunger head.

7. In a fueling nozzle for a closed circuit fuel system as in claim 6, a cylindrical chamber defined in said body concentric to said plunger, said plunger extending into said chamber, a piston within said chamber operatively connected to said plunger, said differential pressure face being defined upon said piston, said chamber communicating with said body passage.

8. In a fueling nozzle for a closed circuit fuel system as in claim 1, pressure regulator sleeve position indicating means mounted upon said body sensing and externally indicating the axial position of said regulator sleeve within said body passage.

9. In a fueling nozzle for a closed circuit fuel system as in claim 8, said pressure regulator sleeve position indicating means comprising a rod mounted in said body for axial displacement therein, said rod having an inner end engagable by said regulator sleeve when said regulator sleeve is adjacent said valve seat and an outer end extendable from said body upon said rod inner end engaging said regulator sleeve.

10. In a fueling nozzle for a closed circuit fuel system as in claim 9, lost motion means defined on said rod intermediate said rod inner and outer ends preventing said rod from interfering with the operation of said regulator sleeve.

11. In a fueling nozzle for a closed circuit fuel system as in claim 1, said second spring means circumscribing said pressure regulator sleeve and being isolated from the fluid flow path within said pressure regulator sleeve.

* * * * *